United States Patent [19]

Kinjo et al.

[11] 3,982,940

[45] Sept. 28, 1976

[54] PROCESS FOR THE FORMATION OF IMAGES

[75] Inventors: Kikuo Kinjo; Hiroshi Matsuno, both of Tokyo; Tetsuo Hasegawa, Hino; Hideo Kato, Yokohama, all of Japan

[73] Assignee: Canon Kabushiki Kaisha, Tokyo, Japan

[22] Filed: Oct. 3, 1974

[21] Appl. No.: 511,756

[30] Foreign Application Priority Data

| | | |
|---|---|---|
| Oct. 5, 1973 | Japan | 48-112141 |
| Jan. 31, 1974 | Japan | 49-13022 |
| Feb. 8, 1974 | Japan | 49-15964 |

[52] U.S. Cl. ..... 96/27 R; 96/29 R; 96/29 D; 96/83

[51] Int. Cl.[2] ..... G03C 5/04

[58] Field of Search ..... 96/27 R, 29 R, 29 D, 96/48 HD, 64, 65, 68, 83, 85, 86 R, 87 R; 156/230

[56] References Cited

UNITED STATES PATENTS

| | | | |
|---|---|---|---|
| 3,219,445 | 11/1965 | LuValle et al. | 96/27 R |
| 3,282,643 | 11/1966 | Smith et al. | 96/83 |
| 3,282,698 | 11/1966 | Verelst et al. | 96/83 |
| 3,282,765 | 11/1966 | Pine et al. | 96/27 R |
| 3,476,937 | 11/1969 | Urancken | 96/27 R |
| 3,730,717 | 5/1973 | Chu et al. | 96/27 R |

FOREIGN PATENTS OR APPLICATIONS

| | | | |
|---|---|---|---|
| 1,068,557 | 5/1967 | United Kingdom | 96/27 R |
| 554,292 | 6/1943 | United Kingdom | 96/27 R |
| 577,230 | 5/1946 | United Kingdom | 96/27 R |

*Primary Examiner*—Caleb Weston

*Attorney, Agent, or Firm*—Fitzpatrick, Cella, Harper & Scinto

[57] ABSTRACT

The present invention relates to a process for transferring a previously formed image onto an image-forming member. The process of the invention comprises forming a positive image on a releasable image-forming layer from a negative image by the dye transfer method or the inversion method, followed by releasing and transferring only the said image-forming layer onto the above-mentioned image-forming member by means of, for example, heat, pressure or electron beam.

14 Claims, 17 Drawing Figures

PROCESS FOR THE FORMATION OF IMAGES

BACKGROUND OF THE INVENTION

1. Field of the Invention

The present invention relates to a process for the formation of an image (obtained by the commonly known photographic means) on a desired image-forming material, by way of a further application of the commonly known photographic means. In particular, it relates to a process for the formation of an image which is applicable to the case, for example, in which a facial photograph is to be made on a hydrophobic high polymeric material such as an ID card.

2. Description of the Prior Art

There are known several prior art methods in the field of image recording. Among them are included the silver salt photography method and the coloring matter diffusion transfer method which comprises placing a photosensitive agent previously on a supporting material and forming an image directly on the supporting material, and the printing method which comprises printing an image previously on a releasable layer and transferring only the printed image onto another material.

All these methods are disadvantageous in that the handling of materials is restricted if the supporting material is always coated with a photosensitive agent, and in that the supporting material is apt to be released from the photosensitive agent layer or cracks are readily formed in the supporting material and the photosensitive layer. Accordingly, the field of use of these methods is very restricted. In addition, when the printed image is transferred onto a supporting material, only the image is transferred so that the selection of the supporting material is restricted. Also, these methods cannot give as clear images as those given by photography. Moreover, these methods require complicated processes which are particularly ineffective when the number of copies to be prepared is small.

Accordingly, if it is possible to form on an optionally chosen image-forming material an image with excellent image properties comparable to those possessed by photographic images, such as sharpness and resolution power, a very effective means will be provided for use in such fields as decorations, an original figure for an over-head projector and ID cards.

The reasons why a photographic image has so far been unable to be formed on the above-mentioned image-forming materials are that the photosensibility, the coating workability, the filmforming property and the adhesive property of the photographic photosensitive material itself are inconvenient for use with an optionally chosen image-forming material.

SUMMARY OF THE INVENTION

The above-mentioned, restricted, image-forming means in the prior art has a fatal defect that an image cannot be formed on an optionally chosen image-forming material.

Therefore, it is the principal object of the present invention to provide a means by which a photographic image itself can be formed on an optionally chosen image-forming material.

It is another object of the invention to provide a specific means of forming a photographic image or, more specifically, of transferring the image.

It is a further object of the invention to provide, in the said transferring means, a further superior method and the material used in the said method.

It is still another object of the invention to provide the construction and material of an ID card, based on the discovery that the process of the invention is particularly suitable for the preparation of an ID card among the materials which can form an image thereon.

In accordance with the present invention, there is provided a process for the formation of an image which comprises forming a photographic image on a photosensitive layer provided on a supporting material, binding the photosensitive layer to a take-up material through interposition of an adhesive, said photosensitive layer exhibiting a film-forming property in itself, and thereby forming the photographic image on said take-up material.

BRIEF DESCRIPTION OF THE DRAWINGS

Among the accompanying figures.

DESCRIPTION OF THE PREFERRED EMBODIMENTS

In the present invention, a photosensitive layer capable of forming a positive image is provided on a supporting material and a positive image is formed on said photosensitive layer and said formed positive image is transferred onto the desired take-up material to thereby form the ultimate image.

The said positive image may be formed either by forming a negative image followed by inversing the image to give a positive image or by connecting a negative silver salt image into a positive image by means of the diffusion transfer method.

The said positive image may also be formed by the known method for forming a positive image on a photographic printing paper.

The process of the invention will be further illustrated with reference to the accompanying drawings. A photographic positive image is formed by applying exposure to the photosensitive agent as shown, for example, in FIG. 1 to FIG. 5.

Figure 1:
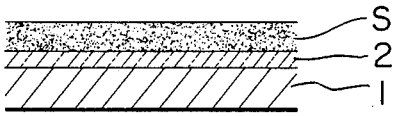
FIG. 1 to FIG. 5 illustrate the cross sections of the layers capable of forming a photographic image according to the invention, with which the structure of the layer is explained.

FIG. 1 illustrates a case in which a printing paper is constructed from a hydrophilic supporting material 1 above which an underlying layer 2 and a silver emulsion layer S are formed in the named order. A photographic image is obtained by subjecting the silver emulsion layer S to the steps of development, fixing and washing with water.

Figure 2:
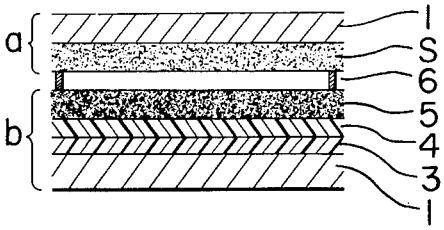

FIG. 2 illustrates a printing paper comprising a negative image forming zone *a* and an accepting layer zone *b*. The negative image forming zone *a* is composed of the silver halide emulsion layer S placed on the transparent supporting material 1. On the layer S a negative image is formed by the silver diffusion transfer method and is then dye-transferred to an accepting layer 5 by the action of an alkaline treating agent. The accepting layer 5 is the upper layer of the accepting layer zone b. Under the accepting layer 5, there are formed a neutralization layer 4 (which is for the purpose of neutralizing the said treating agent) and a layer 3 which is composed of, for example, diacetate film and prevents the dyetransferred coloring matter image from permeating the hydrophilic supporting material 1. Numeral 6 denotes a spacer for fixing the film thickness of the treating agent, that is, forming an interstice where said treating agent cts.

Both FIGS. 1 and FIG. 2 illustrate the cases of monocolor. The cases of multi-color will be described below with reference to FIG. 3 to FIG. 5.

Figure 3:
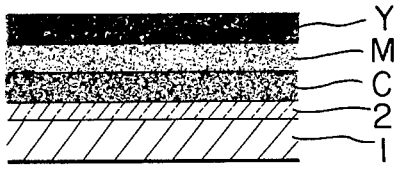

In FIG. 3, an underlying layer 2 is placed on the hydrophilic supporting material 1. On the underlying layer 2, a cyan layer C, a magenta layer M and a yellow layer Y are individually formed, giving three layers the total. A multi-color image is formed by irradiating the layers with a coloring matter image which can act upon each of the layers, followed by color-development of the silver halide emulsion with p-phenylenediamine developing agent, de-silverizing fixation and washing with water.

Figure 4:
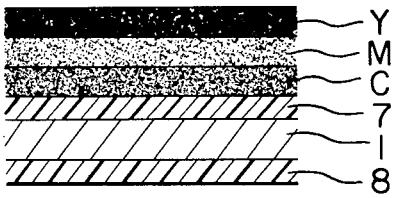
Figure 5:
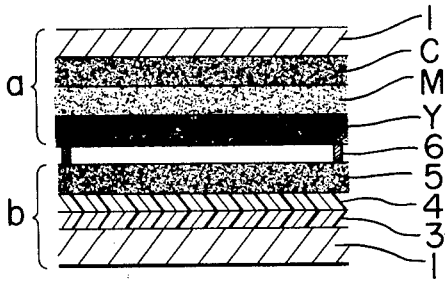

In the case of FIG. 4, the hydrophilic supporting material 1 is coated with, for example, polyethylene terephthalate films 7 and 8. On the resulting layer 7, a cyan layer C, a magenta layer M and a yellow layer Y are placed. A multicolor image is formed, for example, by the silver dye bleaching method. In the case of FIG. 5, a printing paper is constructed from a negative image forming zone *a* and the accepting layer zone *b* in a similar manner to that shown in FIG. 2. In the said negative image forming zone *a*, the cyan layer C, magenta layer M and yellow layer Y are placed, and a color diffusion negative image is formed thereon. A positive photographic image is formed by dye-transferring said image to the accepting layer 5. All of the above-mentioned processes are suitable for the formation of a single image, because the photosensitive layer is formed independently.

A continuous operation is particularly effective because the treatment after the image-formation can be simplified. This can be suitably realized, in the invention, by employing a construction in which a transparent or semitransparent supporting material has a photosensitive layer and a high polymeric protecting layer which can ultimately function as a protecting film and can bind the photosensitive layer to the supporting material through the protecting layer. This embodiment will be explained in detail with reference to the accompanying drawings.

Figure 6:
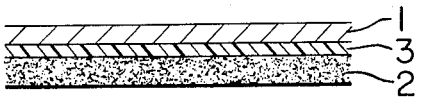
FIG. 6 to FIG. 10 illustrate the steps of forming an image in an embodiment of the invention.

FIG. 6 illustrates a photosensitive member comprising a photosensitive layer 2 which is placed on the transparent or semitransparent supporting material 1, as mentioned above. As will be understood from the detailed description below, a high polymeric protecting layer 3 is provided between the photosensitive layer 2 and the supporting material 1. The said high polymeric protecting layer 3 functions as an ultimate protecting layer and as a binder for binding the photosensitive layer 2 to the supporting material 1. The relationship between the supporting material 1 and the high polymeric protecting layer 3 and their functions will be stated later.

As the material constituting the photosensitive layer 2, for example, the commonly used silver salt type photosensitive material, a silver salt film and a printing paper for a slide, and a positive image accepting layer usable for the silver salt diffusion transfer method can be used. Each of these materials is formed into a photosensitive layer in accordance with known techniques.

However, the operation of the subsequent treatment depends on the nature of the photosensitive layer. A few representative examples will be shown below. However, they are not to be considered limitations upon the invention. Any other operation may be appropriately selected and employed.

1. The case in which the accepting layer capable of being used in the silver salt diffusion transfer method is used as the photosensitive layer 2 (FIG. 7 – FIG. 10).

Figure 7:
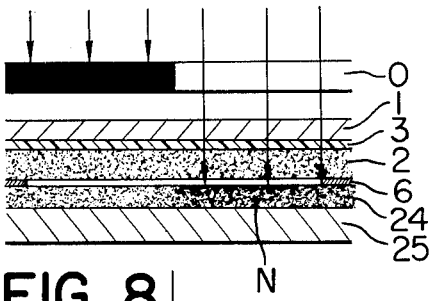

The photosensitive member is constructed in such a manner as shown in FIG. 6. A silver salt negative film 24, which coats a base material 25 to give a negative film, is tightly bound with a accepting layer 2 through the spacer 6 as shown in FIG. 7.

The spacer 6 provides a space through which the development treating agent can act at the stage of the subsequent development. Accordingly, the space is not required at the initial stage, but it is more preferable that the space be provided from the beginning because the paper can then be immediately developed in such a condition. At the time of the formation of a negative image, the negative film 24 may be brought into contact with the accepting layer 2, or they may be spaced apart as shown.

Figure 8:
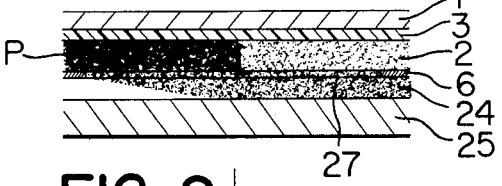
Figure 9:
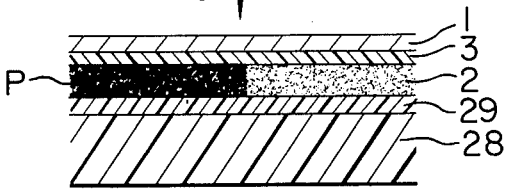
Figure 10:
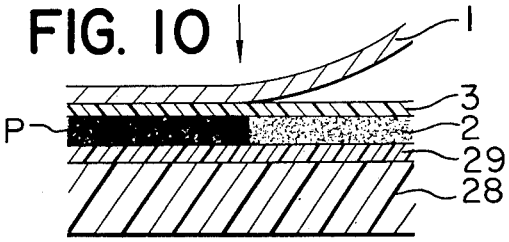

After the negative film 24 is disposed opposite the accepting layer 2, an image exposure is applied thereto from the side of the original O, the transparent material 1. The light passes through the transparent, supporting material 1, the high polymeric protecting layer 3 and the accepting layer 2 to reach the silver salt negative film 24 and form a negative image N on the negative film. A treating agent 27 is inserted into the space controlled by the spacer 6, as shown in FIG. 8. As a result, the negative image is diffused so that a positive image P is formed on the accepting layer 2. After the positive image P has been formed, the negative film 24 is released from the accepting layer 2 and, if necessary, the accepting layer 2 is placed on a take-up material 28 having a underlying layer 29 as shown in FIG. 9. Then the positive image P is united with the take-up material by an appropriate adhesion treatment, after which the supporting material 1 is peeled off to obtain the ultimate image (FIG. 10).

Figure 11:
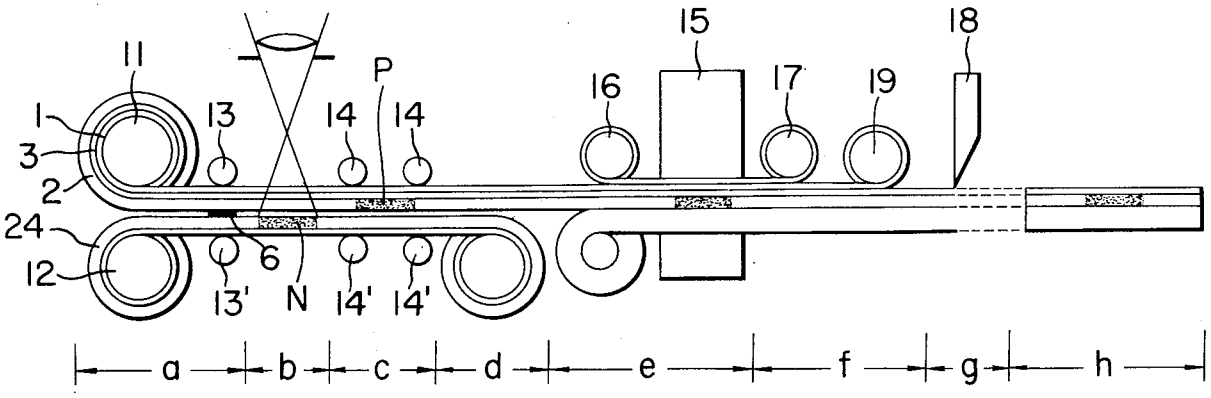
FIG. 11 and FIG. 15 illustrate an embodiment in which the above-mentioned image formation is effected according to a series of continuous operations.

If the above-mentioned steps are to be carried out by one continuous step, the apparatus as illustrated in FIG. 11, for example, will be conveniently used.

In FIG. 11, each of the steps is represented by symbols *a* to *h*. The steps will be detailed below. Symbol *a* denotes the starting portion in which a photosensitive member 11 (having the positive accepting layer 2, the high polymeric protecting layer 3 and the transparent or semitransparent supporting material 1) and a negative film portion 12 (having the negative film 24) are stored. If necessary, they may be unified by the aid of transporting rollers 13 and 13', through interposition of the spacer 6. The spacer 6 is not always to be held in this zone, but it must be held within a developing portion *c*.

After the unification, in an exposure, portion *b*, an exposure is applied to the negative film 24 in accordance with an image to form a negative image N on the negative film 24. In this case, the exposure is effected from the side of the supporting material 1. However, it is a matter of course that the exposure may also be effected from the side of the negative film 24. Further, the exposure from the accepting layer side is advantageous in that the handling can be carried out under room light and that the position of the image on the take-up material can readily be regulated by the naked eye.

After the negative image has been formed, it is sent to the developing portion *c*, where the negative image N is converted to a positive image P by insertion of a development treating agent into the space controlled by the spacer 6 and, at the same time, the positive image P is formed on the accepting layer 2. Numeral 14 denotes a pressure- and transportation-roller which makes the action of the treating agent more effective. After the positive image P has been formed in the developing portion *c*, the negative film 24 becomes unnecessary so that it is wound out in a zone *d*.

On the other hand, the positive image is sent to the subsequent step where it is stamped to the take-up material.

FIG. 11 illustrates a case in which the hot stamping is effected by a hot stamper 15 in a stamping zone *e*.

In the case of the hot stamping, a protecting film 16 is provided as shown in the drawing. However, it is not always necessary and sometimes it can be substituted by the supporting material 1, as mentioned later.

In the latter case, the transparent or semitransparent supporting material 1 functions as a protector between the hot stamper and the image. However, the function of the supporting material 1 is not always the same, but is diverse in accordance with whether it acts as a mere protector for the formed image.

That is, when the supporting material 1 acts merely as a protecting film at the time of the hot stamping, it is unnecessary after the image has been formed, and therefore, it is wound out by a winding roller 19 which functions as a mere winding means (zone *f*).

In this case, the protection of the formed image is alternately effected by the high polymeric protecting film 3 which originally functions as an adhesive. It is desirable that the high polymeric film 3 be released from its adhesion to the supporting material 1 by the action of the hot stamping to come into use as a protecting film.

When the supporting material 1 functions as a protecting film for the formed image, it is desirable that the high polymeric protecting film exhibits a strong adhesive power in order to strengthen its adhesive property to the image under the condition of the hot stamping.

At any rate, the necessity of the protecting film 16 depends upon the function of the supporting material 1, and the apparatus itself is to be modified in accordance with the function of the supporting material. When the protecting film 16 is present, it is wound out by the roller 17 in the above-mentioned winding zone *f*.

Thereafter, if necessary, cutting is effected by a cutter 18 in a cutting zone g into an appropriate and desired size to give the ultimate image h.

The image is formed on the take-up material in the above-mentioned manner.

2. Next, another case in which a usual silver salt film is used will be described below.

Figure 12:
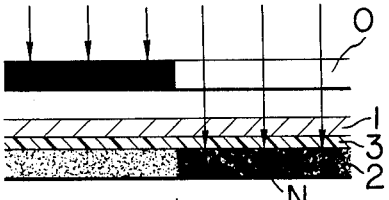
FIG. 12 to FIG. 14 illustrate the steps of forming an image in another embodiment of the invention.
Figure 13:
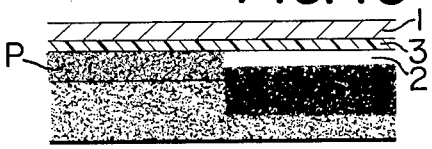
Figure 14:
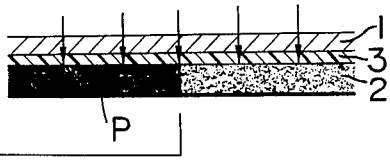

An example in which a positive film is used is shown in FIG. 12 to FIG. 14.

The construction of the photosensitive member can be represented in a similar construction to that shown in FIG. 6 in the above case (1).

That is, the silver salt positive film 2 is formed on the transparent or semitransparent supporting material 1 through interposition of the high polymeric protecting film 3 exhibiting an adhesion property.

An image exposure is applied to the photosensitive member. The example shown below exemplifies the formation of a positive image on a silver salt film. It is a matter of course that other methods for forming positive images can also be used for the purpose.

Here is shown an example which is generally called the bleaching method. As is shown in FIG. 12, if an original image O is exposed, the exposed zone N (the right half of the silver salt positive film 2) is sensitized by the light. Then, as is shown in FIG. 13, the exposed zone N is bleached so that only the unexposed zone P (the left half of the silver salt positive film 2) remains. The whole area is uniformly exposed as is shown in FIG. 14 to give a positive image on the unexposed zone P.

The image thus formed is transformed to the take-up material according to the procedures shown in FIG. 9 and FIG. 10.

Figure 15:
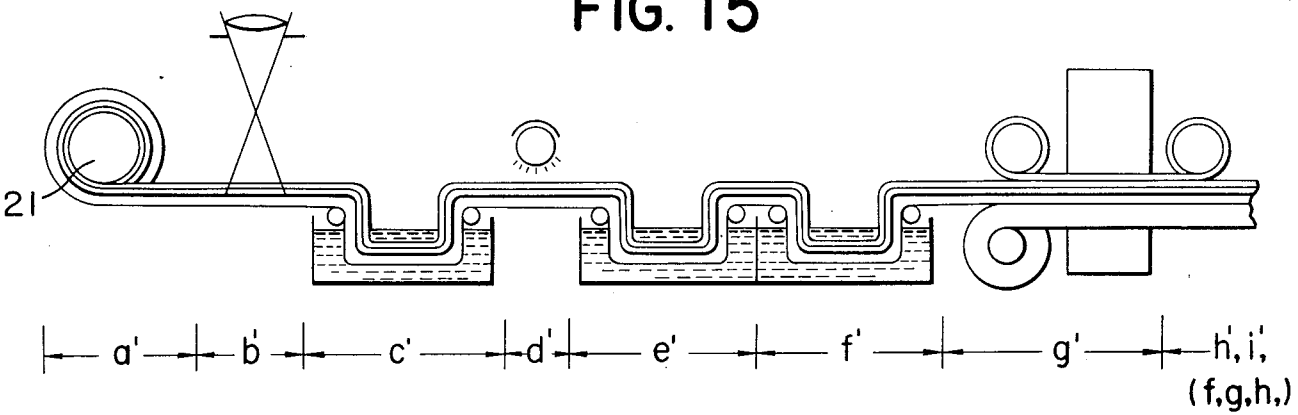

If this formation of the image is to be effected by a series of operations, it is possible to use, for example, the apparatus as shown in FIG. 15.

That is, the photosensitive member is fed by a roller 21 (zone *a'*) which is exposed in an image exposure zone *b'*. The photosensitive member is passed through a bleaching zone *c'*, a uniform exposure zone *d'*, a development zone *e'* and a fixation zone *f'* to form an image and thereafter treated in a similar manner to that in the stamping zone *e* and the subsequent zones as shown in FIG. 11.

In the image-forming process represented by the abovementioned processes, the requirements are as follows.

The photosensitive member is constructed in such a manner that, as has been mentioned above, a photosensitive layer is placed on a transparent or semitransparent supporting material through interposition of an adhesive high polymeric coating. The transparent or semitransparent supporting materials which can be used include resinous films such as fluorinated films, polyethylene, polyester, oriented polypropylene films, polystyrene, polyvinyl chloride and the like as well as a glass plate. It is necessary for the supporting material to be free of wrinkles.

The reason why these conditions must be fulfilled is that the image-forming process includes a high temperature step or a step for application or drying of various materials.

The effect of employing the transparent or semitransparent supporting material is that the formed image can be seen by the naked eye so that the registration of the photograph is facilitated. In the case in which the supporting material is semitransparent, the image can also be seen either from the backside or by reflection so that a judgement by reflective intensity is facilitated. The term "transparent" as used herein means that the transmissivity is greater than 50 percent.

These supporting materials should be selected, as has been mentioned before, in connection with the adhesive high polymeric protecting layer. At any rate, it is necessary that the material does not deform at elevated temperatures.

The heating treatment is carried out at a temperature below about 100°C. Accordingly, the supporting material is required to exhibit heat resistance at a temperature of about 100°C and above.

Further better results will be obtained if the supporting material has a high heat conductivity and rigidity. Where the binding step is carried out by heating, the step is accelerated by the heat conducted through the supporting material. Accordingly, the higher heat conductivity of the supporting material promotes the binding and shortens the time period required for it. Preferably, the supporting material has a heat conductivity of $3 \times 10^{-4}$ cal/cm.deg.sec. and above. A particularly high effect is attained by a heat conductivity of $7 \times 10^{-4}$ cal/cm.deg.sec and above.

On the other hand, it is also natural that the binding process is dependent upon, besides the characteristics of the material itself such as the above-mentioned resins and the like, the thickness of the material. Though the preferred thickness somewhat depends on whether the supporting material function as a protector for the ultimate image or as a protector only in the course of the heating step, a thickness of less than about 100 microns is enough to satisfy the requirements in the practical use.

Important is ascribed to the rigidity of the supporting material when it is heated and pressed or after the ultimate image is formed. Accordingly, the supporting material is preferred to have as high a rigidity as possible.

Next, the adhesive high polymeric protecting film will be described. It is essential for the film to have, particularly, an excellent adhesive property to the photosensitive layer. The image-formation on the take-up material is preferably carried out at elevated temperature and pressure.

Hot melt type adhesives and photo-polymerization type sticking agents may be mentioned as the materials which have a high adhesive property under such conditions.

Concretely speaking, such materials which can be used include a vinyl chloride polymer, a vinyl chloride-vinyl acetate copolymer, a vinyl chloride-vinyl acetate-acrylic polymer, an acrylic monomer capable of forming a crosslinkage, benzoinalkylether, polyalkyl acrylates, and the like, all of which can be used in a thickness of lss than 10 microns. A thickness of 1 to 8 microns is particularly preferable.

Though the use of the above-mentioned adhesives is essential to the practice of the invention, other usual adhesive materials having the above-mentioned ability may also be used in the invention.

When the above-mentioned transparent or semi-transparent supporting material exists as a supporting material for the ultimate image, the adhesive should be tightly bound with the supporting material. On the contrary, when the adhesive layer itself functions as a surface protecter, the adhesive should be well releasable from the supporting material. Accordingly, both supporting material and adhesive must be selected by taking their mutal relationship as above indicated into consideration.

At the time of the selection, a particular consideration should be paid so as to let their characteristic functions manifest themselves when elevated temperatures and pressures are applied.

In the above descriptions, the term "adhesive" means the material which exhibits an adhesive property between the supporting material 1 and the photosensitive layer as shown in FIG. 6 or exhibits a protecting film property. Apart from it, it is also required to provide an adhesive between the take-up material and the positive image forming layer i.e. the photosensitive layer when a positive image is to be transferred onto the take-up material.

In the transferring step, a hot melt adhesive is used as a means for enhancing the efficiency of transferring and making the transferred image unreleasable. It an adhesive which softens at usually encountered temperatures is used for this purpose, it may be released during the use. Accordingly, the softening temperature of the adhesive is preferred to be as high as possible. For example, the following hot melt type adhesives can be used for this purpose:

Ionomer resin, vinyl acetate resin, vinyl acetate-vinyl chloride copolymer resin, vinyl chloride-vinylidene chloride copolymer resin, polyvinylbutyral, acrylic acid resin, polyamide, polystyrene, nitrocellulose, acetyl cellulose, SBR, Neoprene, chlorinated rubber, butyl rubber, nitrile rubber, phenolic resin, resorcinol resin, polyester resin, polyurethane, epoxy resin, phenolic resin-modified vinyl resins, phenolic resin-modified Neoprene, nitrile rubber-modified phenolic resin, phenolic resin-modified polyamide, phenolic resin-modified epoxy resin, epoxy-modified polyester, epoxy-modified polyamide, epoxy-modified polysulfide rubber and the like as well as the combinations thereof.

The above-mentioned hot melt adhesives may be placed either on the take-up sheet or on the above-mentioned photographic image. When a photographic image is to be transferred, the temperature and pressure should be adjusted to the respective values at which the hot melt adhesives can soften. Accordingly, the temperature is determined depending upon the nature of the hot melt adhesive used, and can not be determined indiscriminately. Though the pressure also varies depending upon the naure of the adhesive, a sufficient effect is exhibited at a pressure of about 5–10 kg/cm². If the pressure is too low, the transferring step cannot be effectively done. If it is too high, there is a risk of thermally diffusing the image portion. The photographic image is transferred to the take-up sheet by the action of heat and pressure as above, after which the supporting material is peeled off.

The selection of the aforementioned photosensitive layer can be made without any difficulty, and any usual form can be adopted for the purpose. For example, it may be selected from the diffusion transfer type of negative image forming films and positive image accepting layers, with respect to the abovementioned method (1). On the other hand, with respect to the method (2), a usual positive printing paper may be used.

It is also possible in these photosensitive layers to provide an underlying layer between the photosensitive layer and the base material. The underlying layer can serve in various senses. For example, if functions as an adhesive between the photosensitive layer and the base material, as a printing layer capable of giving various patterns to the base material after the formation of an image, as a filter layer capable of acting as various filters, as an anti-permeation layer capable of preventing the permeation of development treating agent etc., and the like.

All these functions should be considered separately in accordance with the respective purposes.

Owing to the adhesive function, it can serve as an adhesive layer capable of exhibiting similar functions and effects to those of the aforesaid adhesive.

It is preferred for each of the above-mentioned functions to manifest itself independently. However, it is also similarly preferred for the functions to manifest themselves in combination with other functions.

Regarding the thickness of the underlying layer, the layer can satisfy the requirement of the invention so far as it is a thin layer. Most preferably, however, it has a thickness of about 1 to 10 microns. The underlying layer may be either treated on its whole surface area or only partially treated according to its purpose. It is also possible in the case in which a light screen layer is formed, to let the underlying layer have a light screening ability so that any particular light screening layer can be omitted.

As the take-up material to which the image is to be transferred, hydrophobic high polymeric take-up materials or hydrophilic take-up materials such as leather, papers, glass, metals and fibers may be used. Particularly, in the case of the hydrophobic high polymeric take-up material, an image formation thereon has so far been difficult due to the difficulty with which a gelatin emulsion layer is formed on the take-up material. On the contrary, in the invention, the formation of an image can be quite readily effected due to the use of the above-mentioned hot melt adhesives as well as due to the newly discovered transferring means which will be detailed later. This greatly broadens the application range of the take-up materials.

Simultaneously, this enables one to form various images in accordance with a wide variety of purposes. For example, an image can be formed on an original paper for an over-head projector paper or an ID card, both of which serve as hydrophobic high polymeric take-up materials. The take-up material for the ID card is quite effective in that a facial photograph of the user or other discriminable information can be formed on the surface of the card. A further effect is obtainable by, for example, forming an image in the core material itself of the card and then applying a hydrophobic high polymeric sheet on it, for the purpose of eliminating the superficial unevenness or preventing forgery or alteration of the image. If the core material is film-formable in itself, there is no need to use a particular supporting material. In such case, however, it is also permitted to use a usual supporting material. It is also preferable to let the core material be exposed only in the image-forming portion and to coat the remaining portion with a hydrophobic high polymeric material and the like. When a plastic type take-up material, such as polyvinyl chloride, polypropylene, polystyrene, a methacrylic resin and the like are employed, besides the aforementioned hot melt type adhesives, the transferring means can be rendered more effective by means of dielectric heating.

In this method, a positive image is formed on the take-up material by introducing a dye transferring solvent into the space between a plastic plate which serves as the take-up material and a previously formed positive image, followed by heating the solvent by way of dielectric heating. The transfer dyeing solvent is introduced either by introducing it directly into the image-forming zone of the take-up material or by forming a frame for limiting a zone on the take-up material followed by introducing the solvent into the frame.

As the dye transferring media, those which can dissolve the coloring matters contained in a silver salt photographic printing paper, a silver salt photographic film or a diffusion transfer-immediate printing paper and which can affect plastic plates or films are preferably used. The solvents which can be preferably used include, for example, dimethylacetamide, dimethylformamide, formamide, dimethylsulfoxide, MEK, toluene, ethanol, methanol, tetrahydrofurfuryl alcohol, dimethylacetamide, water and the like as well as mixtures thereof.

The quantity of such dye transferring solvent adhering to the take-up material is preferably about 0.1 to 2.0 ml per 1 $cm^2$. If the quantity is less than 0.1 ml, the dye transferring effect is hardly observed. If the quantity is larger than 2.0 ml, unevenness of the formed color or smudging is apt to appear.

As a means for increasing the apparent quantity of the solvent, it is also effective to roughen the film surface by means of ultrasonic treatment or sand blast treatment.

As mentioned above, a dye transferring solvent is placed on the take-up material, on which a previously formed image is settled, and then dielectric heating is effected. It is also permitted to inject the transfer dyeing solvent between the take-up material and the image after the image has been settled.

The preferred frequency of dielectric heating is 400 KHz to 3000 MHz, and particularly 2450 35 50 MHz.

A greater value of dielectric loss of the dye transferring solvent requires less consumption of time for the heating and, at the same time, a better result in the dye transferring. The greatness or smallness of the dielectric loss can be judged from the magnitude of (epsilon $s$ X tan$\delta$ ) where epsilon s is a specific dielectric constant and tangent delta is a dielectric loss tangent.

However, both epsilon s and tangent delta vary with the given frequency, temperature and the nature of the atmosphere. Also, the effect of epsilon s and tangent delta of the coexisting plastic film or plate cannot be neglected.

If a substance of a high dielectric constant, such as Rochelle salt, barium titanate, ammonium sulfate, ZnO and the like is dissolved or dispersed into the dye transferring solvent, the efficiency of the dielectric heating increases more. Among them, Rochelle salt is so effective that if it is dissolved into a dye transferring solvent, the time period of the dye transferring can be shortened to ½ as compared with the solvent not containing Rochelle salt.

Next, the concrete means for peeling off the supporting material, in the case in which it needs to be peeled off from the positive image forming layer supported by it, will be described.

Figure 16:
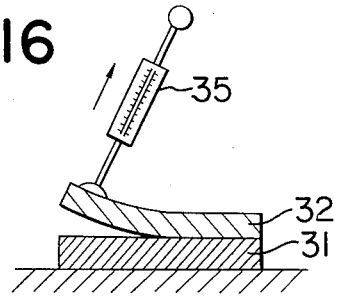
FIG. 16 and FIG. 17 illustrate an experimental example in which the supporting material is just being peeled off.
Figure 17:
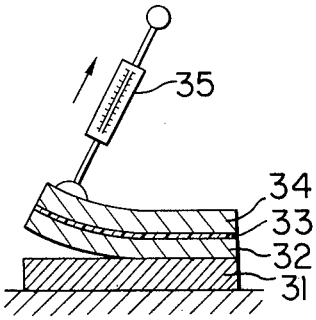

The peeling can be effected either mechanically or chemically. The mechanical means adoptable include cutting, grinding and exfoliation. However, the cutting is not practical in that the state of the cutting cannot be controlled readily so that there is a risk of wounding the image. The grinding is effective in that it hardly wounds the photographic image. The exfoliation comprises binding the supporting material to a exfoliation material with a greater force as compared with the binding force between the supporting material and the above mentioned photographic image, then peeling off said exfoliative material and thereby releasing the supporting material off simultaneously. This exfoliation method is effective in that the surface of the photographic image is not wounded at all. Embodiments of the exfoliation method are shown in the following table where the binding forces of hot melt adhesives are related with the binding forces at the time of exfoliation. The binding forces to the supporting material have been measured according to the method as illustrated in FIG. 16 and FIG. 17. FIG. 16 illustrates the case in which the accepting layer 32 is peeled off from the supporting material 31. FIG. 17 illustrates the case in which the hot melt adhesive 33 is applied onto the said accepting layer 32, the take-up material 34 is bound on it and then it is peeled off from the supporting material 31. In the figures, numeral 35 denotes a spring balance. The peeling is carried out by stretching it to the direction of the arrow with a stretching force of about 1–2 cm/sec.

| Nature of hot melt adhesive (unreleasable at above 3 kg) | Take-up material | Strength of adhesion to the take-up material | Supporting material |
|---|---|---|---|
| Ethylene-vinyl acetate copolymer adhesive | Metal (roughened surface) | 5.2 kg | Supporting material generally used in the color diffusion transfer method (paper) |
| Ethylene-vinyl acetate copolymer adhesive | Mirror surface | 4.3 kg | |
| Polyamide adhesive | Fiber | 3.3 kg | |
| Polyester adhesive | Polyester sheet | 4.4 kg | |
| Vinyl chloride-vinyl acetate copolymer adhesive | Leather | 3.8 kg | |
| Phenolic resin-modified epoxy adhesive | Glass | 3.7 kg | |

As above, the hot melt adhesives exhibit great binding strengths as compared with those between the supporting material and the accepting layer and effectively binds the image-accepting layer to the take-up material.

The chemical methods include exfoliation and dissolution both using a solvent.

The solvent is selected in accordance with the nature of the supporting material of the photographic image as well as the nature of the adhesive for binding the supporting material.

In the case of the image obtained by the above-mentioned process, the exfoliation of only the supporting material by the use of acetone, MEK, formamide or dioxane and ( /or) the mixture thereof is quite effective. In this case it is also quite effective to remove only the supporting material by dissolving it into an aqueous solution of an alkali such as KOH, NaOH and the like.

In addition, the protecting layer described in the foregoing is preferably transparent or semitransparent.

EXAMPLE 1

To a printing paper having been subjected to the following steps: color development of a silver halide emulsion by the use of a p-phenylenediamine developing agent, silver removal, fixation and washing with water, the following adhesive composition was applied to a dry thickness of 10 microns:

| | |
|---|---|
| Ethylene-vinyl acetate copolymer adhesive | 10 g |

-continued

| | |
|---|---|
| Ethyl acetate | 100 ml |

A polyester film of 25 microns in thickness was placed on the adhesive surface, and they were bound together with an iron at 100°C. Then, the supporting material was released off by the use of the following organic releasing liquid:

| | |
|---|---|
| Acetone | 10 parts |
| MEK | 10 |
| Formamide | 8 |
| Dioxane | 10 |

As a result, a colored image composed only of the silver halide emulsion layer was formed on the polyester film as a transparent film for an over-head projector.

EXAMPLE 2

To a printing paper on which an image was formed by the color diffusion transfer method, the adhesive shown below was applied up to 10 microns in thickness (after drying):

| | |
|---|---|
| Vinyl chloride-vinyl acetate copolymer adhesive | 10 g |
| Ethyl acetate | 50 ml |
| Toluene | 50 ml |

A triacetate film of 25 microns in thickness was placed on the adhesive surface as they were bound together with an iron at 100°C. Then, the supporting material was peeled off several times by adhering Cello-tape (trade name of the product of Sekisui Chemical Co. in Japan) thereto and peeling. Thus the supporting material was completely removed to leave only the color diffusion layer behind. As a result, a slide film composed of the triacetate film on which a clear colored image was present was obtained.

EXAMPLE 3

A printing paper having been subjected to the following steps: color development of a silver halide emulsion by the use of p-phenylenediamine developing agent, silver removal, fixation and washing with water, was treated in a similar manner to that in Example 1.

A polyester film of 25 microns in thickness was placed on the adhesive surface and both were bound together with an iron at 100°C. Then, the supporting material was released off with the following alkaline releasing liquid:

| | |
|---|---|
| NaOH | 5 g |
| $H_2O$ | 100 ml |

Thus, only the colored silver halide layer remained on the polyester film to yield a usable transparent film for an overhead projector.

EXAMPLE 4

To a printing paper having an image obtained by the color diffusion transfer method, the following adhesive was applied up to 10 microns in thickness after drying:

| | |
|---|---|
| Ethylene-vinyl acetate copolymer Soalex S 5001 (Nippon Synthetic Chemical Industry Co.) | 10 g |
| Ethyl acetate | 50 ml |

A cattle leather of 1 mm in thickness was placed on the adhesive surface and they were bound together with an iron at 60°C. The supporting material was released by immersing it into the following organic solvent type releasing liquid for one minute:

| | |
|---|---|
| Acetone | 30 ml |
| Formamide | 70 ml |

Thus, the cattle leather having a clear colored image thereon was obtained.

EXAMPLE 5

The procedure of Example 4 was repeated except that the take-up sheet (cattle leather) used in Example 4 was replaced by a heat resistant glass plate, Pyrex (trade name) of 5 mm in thickness.

Thus, the heat resistant glass plate having a clear color image thereon was obtained.

EXAMPLE 6

To a printing paper having an image obtained by the color diffusion transfer method, the following adhesive was applied up to a dry thickness of 10 microns:

| | |
|---|---|
| Polyamide resin, Versamide (trade name of the product of Daiichi General K.K.) | 5 g |
| M.E.K. | 50 ml |

Then, a white cotton cloth prepared by weaving yarn of 30 denier was placed on the adhesive surface and both were bound together with an iron at 100°C. The supporting material was released by immersing it into a releasing liquid composed of 100 percent dioxane. Thus, a cotton cloth having a clear colored image thereon was obtained.

EXAMPLE 7

To a printing paper having an image formed by the color diffusion transfer method, the following adhesive was applied up to a dry thickness of 10 microns:

| | |
|---|---|
| Polystyrene resin, Piccolastic D-100 (trade name of the product of Esso Petroleum Co.) | 5 g |
| M.E.K. | 50 ml |

Then an Al plate of 0.5 mm in thickness was placed on the adhesive surface and both were bound together with an iron at 120°C, after which the supporting material was peeled off with Cellotape (manufactured by Sekisui Chemical Co.). Thus an Al plate having a clear color image thereon was obtained.

EXAMPLE 8

A polyester film of about 50 microns in thickness (Lumilar S manufactured by Toray Industry, Inc.) was used as a transparent supporting material. Onto the film were applied 10 g of a vinyl chloride-vinyl acetate copolymer resin (10 g of Saibinol BE-L3 (trade name of the product of Saiden Chemical Co.), 10 g of Sailbinol C (trade name of the product of Saiden Chemical Co.) and 100 ml of toluene with a wire bar and dried at 80°C to form an adhesive layer.

Next, 20 g of polyvinyl alcohol, 10 g of polyvinylpyridine and 0.2 g of a curing agent were applied onto the above-mentioned adhesive layer with a wire bar and dried at about 80°C to form an image-accepting layer.

As a negative film, Polacolor Type 108 (trade name of a product of Polaroid Co.) was used. Both were placed one or another and exposed to light from the side of the abovementioned photosensitive layer. After development, it was dipped into a 5 percent aqueous solution of acetic acid for the purpose of neutralization.

Next, a take-up material was prepared by applying 10 g of Viron 300 (trade name of a product of Toyo Spinning Co.,) and 100 cc of toluene onto a saturated polyester with a wire bar, followed by drying it at 80°C during which an underlying treatment was effected. The take-up material thus obtained was placed on the image portion, and the transferring was effected at about 120°C at a pressure of 6 kg/cm$^2$ for a period of about 5 seconds with a hot stamper (Hot Stamper AC-6, manufactured by Taihei Industry Co.,). After 10 seconds had elasped, only the transparent supporting material was peeled off.

Thus, a clear image which was not releasable was obtained. Abrasion with a elastic matter yielded no observable injury on the image.

EXAMPLE 9

The procedure in Example 8 was repeated except that 10 g of Saibinol BE-L3 (trade name of the product of Saiden Chemical Co.) and 100 ml of toluene were applied onto a vinyl chloride-vinyl acetate copolymer as an underlying treatment. An effect similar to that in the foregoing Example 8 was obtained.

In addition, the conditions of the transferring were: 100°C, 5 kg/cm$^2$ and 3 seconds.

EXAMPLE 10

The procedure of Example 8 was repeated except that 10 g of vinyl chloride polymer and 100 ml of toluene were used as the adhesive for the photosensitive layer. The effect obtained was comparable to that in Example 8.

EXAMPLE 11

The procedure in Example 8 was repeated except that an oriented polypropylene film (manufactured by Toray Industry, Inc., 100 microns in thickness) was used as a transparent supporting material. The effect obtained was comparable to that in Example 8.

EXAMPLE 12

The procedure in Example 8 was repeated except that the transparent supporting material used in Example 11 was used and that the take-up material subjected to underlying treatment in Example 9 was used. The effect obtained was comparable to that in Example 8.

EXAMPLE 13

To a printing paper having a color positive image, an adhesive of the following ingredients was applied with a wire bar and dried, and the color positive image printing paper was constructed from a supporting paper, an intermediate layer 3 (neutralization layer) which covered the supporting paper through interposition of an underlying layer composed of cellulose diacetate, and an accepting layer 4 composed of polyvinyl alcohol and polyvinylpyridine.

| | | |
|---|---|---|
| Adhesive | Vinyl chloride-vinyl acetate copolymer, Saibinol C (trade name of the product of Saiden Chemical Co.) | 50 g |
| | Ethyl acetate | 50 g |

The adhesive was applied up to a dry thickness of 10 microns and dried at 60°C.

Next, the adhesive surface of the above-mentioned printing paper was placed on a vinyl chloride card and stamped at 130°C with a stamping machine (AC-6 type, manufactured by Taihei Industry Co.). Then it was dipped into a releasing liquid shown below at a liquid temperature of 20°C for 5 minutes. Thus the supporting material was released, leaving the accepting layer behind on the card.

| | |
|---|---|
| Formamide | 100 ml |
| M.E.K | 100 ml |

After the solvent remaining on the card had been evaporated out, a hot melt adhesive (manufactured by Deutsch Pigment Kogyo K.K) was stamped on it. The color ID card thus obtained had a mirror image with respect to the original. The image was water-resistant and could not be altered.

EXAMPLE 14

The same adhesive as that used in Example 13 was applied to a vinyl chloride card and dried. The thickness of the adhesive layer was 7 microns after drying and the drying was carried out at 70°C. Then, a color positive image printing paper was placed on the adhesive surface of the card and stamped at 130°C with a hot stamping machine. Treatments similar to those in Example 13 gave a water-resistant color ID card which had a mirror image with respect to the original and could not be altered.

EXAMPLE 15

A printing paper having a color positive image was dipped into a solvent of the following ingredients. The supporting material was released so that only the accepting layer remained.

| | |
|---|---|
| Dimethylformamide | 100 ml |
| M.E.K. | 100 ml |
| Acetone | 100 ml |

Then, the following adhesive was applied to the accepting layer up to a dry thickness of 1.0 micron and dried at 60°C.

| | |
|---|---|
| Vinyl chloride-vinyl acetate adhesive Saibinol SE-LI (trade name of a product of Saiden Chemical Co.) | 10 g |
| Ethyl acetate | 40 g |

A vinyl chloride card, the above-mentioned accepting layer and the hot stamping foil used in Example 13 were placed one on another and stamped. The color ID card thus obtained and water-resistant and could not be altered.

EXAMPLE 16

A color printing paper of the construction shown in FIG. 3 was used. In FIG. 3, numeral 1 denotes a thick paper, numeral 2 denotes a baryta layer and symbols Y, M and C denote yellow, magenta, and cyan layers, respectively. The abovementioned color printing paper was adhered to a vinyl chloride card by the use of an epoxy type adhesive (Cemedine Super, a trade name of the product of Cemedine K.K.). Then, the layers were successively released from the side of the original paper by the use of Cellotape (trade name of the product of Sekisui Chemical Co., Ltd.) until the baryta layer 2 had been completely released, after which the image was transferred to the card. Then a commercially available hot stamping adhesive was transferred onto it. Thus a card having a color image and having no unevenness was obtained.

EXAMPLE 17

The procedure of Example 16 was repeated except that the color printing paper was replaced by the color printing paper as shown below. A thick paper is laminated with two polyethylene terephthalate films on both of its sides. The layers of yellow, magenta and cyan are further placed on one of the laminated films to prepare the color printing paper.

After the treatment, the card obtained had a color image which was superior to the card obtained in Example 16 in its evenness.

EXAMPLE 18

On a surface of a hydrophilic coating on a supporting material, a color image was formed according to the color diffusion transfer method.

The hydrophilic coating was further coated with the following hot melt adhesive and dried.

| | |
|---|---|
| Vinyl chloride-vinyl acetate adhesive, Saibinol C (trade name of a product of a Saiden Chemical Co.) | 50 g |
| Ethyl acetate | 50 g |

Then, the adhesive surface of the hydrophilic coating supported by the above-mentioned supporting material was placed on a core material which was a vinyl chloride sheet containing $TiO_2$, and it was heated and pressed at 80°C for 3 minutes.

The pressed matter was dipped into the following releasing liquid for one minute for the purpose of releasing the supporting material adhering to the hydrophilic coating.

| | |
|---|---|
| Formamide | 100 ml |

-continued

| | |
|---|---|
| M.E.K. | 100 ml |

As a result, the supporting material was released from the hydrophilic coating to leave an image behind which was formed on the core material.

An ID card having a color image was prepared by heating and pressing a transparent film of vinyl chloride onto both sides of the hydrophilic coatings of the core material at a temperature of 90°C under a pressure of about 500 kg/cm². The card thus obtained had a color image which was sealed into the interior portion of the card, so that the card had excellent resistances to abrasion and water and found no unevenness on its surface.

EXAMPLE 19

The procedure in Example 18 was repeated except that a silver halide type of color printing paper based on the oxidative coupling between a p-phenylenediamine developing agent and a coupler was used, instead of forming a color image on a hydrophilic coating surface on a supporting material according to the color diffusion transfer method in Example 18. Thus, a card having excellent resistances to abrasion and water was obtained and there was observed no unevenness on the surface.

EXAMPLE 20

A color image was formed on a hydrophilic coating supported by a supporting material according to the color diffusion transfer method. Then the said hydrophilic coating was further coated with the following hot melt adhesive and dried.

| | |
|---|---|
| Vinyl chloride-vinyl acetate copolymer adhesive, Saibinol C (trade name of Saiden Chemical Co.) | 50 g |
| Ethyl acetate | 50 g |

Then the said supporting material was impregnated with the following releasing material and dried.

| | |
|---|---|
| Acetamide | 5 g |
| Ethanol | 20 ml |

The adhesive surface of the above-mentioned hydrophilic coating supported on the supporting material was placed on a core material of the card which was composed of a vinyl chloride sheet containing $TiO_2$, and pressed at 80°C for about four minutes. The hydrophilic coating was fixed to the core material, while the supporting material was released. Then an ID card having a color image was prepared by pressing a vinyl chloride film onto both sides at 90°C under a pressure of 500 Kg/cm². Thus a card having an image sealed in its interior portion was obtained. The card had excellent resistances to abrasion and water. There was observed no uneveness on its surface.

EXAMPLE 21

The procedure in Example 20 was repeated except that the following releasing material was used in place of the releasing material used in Example 20. Thus a card, having an image sealed in its interior portion, of high abrasion resistance and high water resistance was obtained. There was observed no uneveness on its surface.

| | |
|---|---|
| Amide A-1 (trade name of the product of Nippon Suiso Kogyo K.K.) | 3 g |
| Xylene | 20 ml |

EXAMPLE 22

On a hard card made of a vinyl chloride resin which is conventionally used as a credit card, a shopping card, a bank card and the like, the following solvent mixture was deposited in a proportion of 0.5 ml per 1 cm²:

| | |
|---|---|
| Dimethylformamide | 1 ml |
| Dimethylsulfoxide | 4 ml |

A color slide (Ektachrome X manufactured by Eastman Kodak Co.) having a developed color image was placed on the said hard card and the image was dye-transferred onto the card by subjecting it to a high frequency dielectric heating of 2450 ± 50 MHz for about 30 seconds.

As a result, the image of the color slide was clearly transferred to the card.

In another experiment the same dye transferring was carried by the use of a hot plate heated at 100°C in place of the dielectric heating. In this experiment, the time period consumed was about 5 minutes.

In Examples 23 – 34, the results shown in the following table were obtained under various conditions.

| Ex. No. | Plastic material | Organic solvent | Amount of solvent per cm² | Silver salt film | Silver salt printing paper | Diffusion transfer immediate type printing paper | Frequency of dielectric heating (MHz) | Time consumed for transferring |
|---|---|---|---|---|---|---|---|---|
| 23 | Vinyl chloride card | Dimethylformamide/ dimethylsulfoxide = ¼ (vol.) | 0.5 ml | Fujichrome R-100 supplied by Fuji Film K.K. | — | — | 2450±50 | 30″ |
| 24 | ″ | ″ | ″ | Agfacolor CT-18 supplied by Agfa Co. | — | — | ″ | 30″ |
| 25 | ″ | ″ | 0.8 | — | Ektachrome paper supplied by Eastman Kodak Co. | — | ″ | 20″ |
| 26 | ″ | ″ | ″ | — | RC paper supplied by Eastman Kodak Co. | — | ″ | 20″ |
| 27 | ″ | ″ | 0.9 | | Fuji Brolomide paper supplied | — | ″ | 15″ |

-continued

| Ex. No. | Plastic material | Organic solvent | Amount of solvent per cm² | Silver salt film | Silver salt printing paper | Diffusion transfer immediate type printing paper | Frequency of dielectric heating (MHz) | Time consumed for transferring |
|---|---|---|---|---|---|---|---|---|
| | | | | | by Fuji Film K.K. | | | |
| 28 | " | Dimethylacetamide | 1.0 | — | — | Polacolor type 108 supplied by Polaloid Co. | " | 15" |
| 29 | Vinyl chloride card roughened with 200 mesh glass beads | Dimethylacetamide | 1.2 | — | — | Polacolor type 108 | 2500±50 | 10" |
| 30 | " | Dimethylformamide/ dimethylsulfoxide = 7/3 (vol.) | 0.6 | Ektachrome X supplied by Eastman Kodak Co. | — | — | " | 10" |
| 31 | " | " | 0.8 | — | Ektachrome paper supplied by Eastman Kodak Co. | — | " | 12" |
| 32 | " | " | 0.8 | — | Color paper supplied by Mitsubishi Manufacture Paper Co. | — | " | 12" |
| 33 | Polyvinylidene chloride film | " | 0.5 | — | RC paper supplied by Eastman Kodak Co. | — | " | 10" |
| 34 | " | Dimethylacetamide | 0.5 | — | — | Polacolor type 108 | " | 10" |

We claim:

1. A photographic transfer process for transferring an image comprising the steps of:

1. forming a developed positive image of an original on a film-forming photosensitive layer provided on a support which is at least semi-transparent, said photosensitive layer being separated from and adhered to said support by a first adhesive high polymeric protecting layer which is at least semi-transparent and which is releasably adhered to said support;
2. disposing the resulting photosensitive layer bearing said positive image in a face-to-face relationship with and at a distance from a substrate composed of a hydrophobic polymer;
3. introducing a dye transferring solvent into the space between the image-bearing photosensitive layer and the surface of said substrate, said solvent being capable of dissolving the coloring matter forming said image; and
4. heating the solvent in said space by dielectric heating to dissolve said image and transfer it onto the surface of said substrate.

2. The process of claim 1 wherein said solvent is selected from the group consisting of dimethylacetamide, dimethylformamide, formamide, dimethylsulfoxide, methyl ethyl ketone, toluene, ethanol, methanol, tetrahydrofurfuryl alcohol, dimethylacetamide, water, and mixtures thereof, and wherein said solvent is present in said space in an amount of from 0.1 to 2.0 ml/cm².

3. The process of claim 2 wherein the frequency of said dielectric heating is from 400 to 3,000 MHz.

4. The process of claim 2 wherein a material having a high dielectric constant is dispersed or dissolved in said solvent.

5. The process of claim 4 wherein said material having a high dielectric constant is selected from the group consisting of Rochelle salts, barium titanate, ammonium sulfate and zinc oxide.

6. The process of claim 2 further comprising coating the transferred image with a layer composed of a hydrophobic polymer.

7. The process of claim 6 wherein said hydrophobic polymer is selected from the group consisting of polyvinyl chloride, polypropylene, polystyrene and methacrylic resins.

8. A photographic transfer process comprising the steps of:

1. providing a positive image accepting material useful for a silver salt diffusion transfer method comprising a positive image accepting layer adhered to a support which is at least semi-transparent by means of a first adhesive layer composed of a high polymer which is at least semi-transparent and which is releasably adhered to said support;
2. disposing said positive image accepting layer in a face-to-face relationship with and at a distance from the photosensitive layer of a silver salt negative film;
3. imagewise exposing said silver salt negative film to form a latent negative image;
4. introducing a developing agent into the space between the positive image accepting layer and the imagewise exposed negative film to develop and diffuse the latent negative image and form a positive image in the positive image accepting layer;
5. removing the negative film;
6. binding the resulting positive image accepting material bearing said positive image to a substrate by means of a hot melt adhesive layer; and
7. removing only said support from the resulting material to provide a transferred image on said substrate which image is covered and protected by said adhesive high polymeric protecting layer.

9. The process of claim 8 wherein the imagewise exposure is conducted from the side of the semi-transparent support of said positive image accepting material.

10. The process of claim 9 wherein said binding step (6) comprises contacting said resulting photosensitive layer with said substrate and subjecting the resulting assembly to heat at a temperature less than 100°C. at a pressure of from 5 to 10 kg/cm$^2$.

11. The process of claim 9 wherein said hot melt adhesive layer has a thickness of from 1 to 10 microns and is composed of a member selected from the group consisting of ionomer resin, vinyl acetate resin, vinyl acetate-vinyl chloride copolymer resin, vinyl chloride-vinylidene chloride copolymer resin, polyvinylbutyral, acrylic acid resin, polyamide, polystyrene, nitrocellulose, acetyl cellulose, styrene-butadiene rubber, Neoprene, chlorinated rubber, butyl rubber, nitrile rubber, phenolic resin, resorcinol resin, polyester resin, polyurethane, epoxy resin, phenolic resin-modified vinyl resins, phenolic resin-modified Neoprene, nitrile rubber-modified phenolic resin, phenolic resinmodified polyamide, phenolic resin-modified epoxy resin, epoxy-modified polyester, epoxy-modified polyamide, epoxy-modified polysulfide rubber and mixtures thereof; and wherein said first adhesive layer is composed of a hot melt adhesive or a photo-polymerizable adhesive having a thickness of less han 10 microns.

12. The process of claim 9 wherein said removing step (7) comprises bonding said support to a material with a bonding force greater than the bonding force which exists between said support and said photosensitive layer through said first adhesive layer, and stripping of said material with said support.

13. The process of claim 9 wherein said removing step (7) comprises dissolving said support by contacting said support with a solvent therefor.

14. The process of claim 13 wherein said solvent is selected from the group consisting of acetone, methyl ethyl ketone, formamide, dioxane, an alkali and mixtures thereof.

* * * * *

UNITED STATES PATENT OFFICE

CERTIFICATE OF CORRECTION

Patent No. 3,982,940 Dated September 28, 1976

Inventor(s) KIKUO KINJO, ET AL.

It is certified that error appears in the above-identified patent and that said Letters Patent are hereby corrected as shown below:

Column 2, line 46, "connecting" should read --converting--;

Column 3, line 13, "cts" should read --acts--;

Column 4, lines 34, 35, 36, "original O, the transparent material 1. The light passes through the transparent, supporting material 1," should read --transparent supporting material 1. The light passes through the original O, the transparent, supporting material 1,--;

Column 10, line 29, "2450 35 50 MHz" should read --2450 ± 50 MHz--;

Column 16, line 11, "and water-resistant" should read --was water-resistant--;

Column 18, in the Table for Example 27, under the heading "Silver salt printing paper", "Fuji Brolomide paper supplied" should read --Fuji Brolomide paper supplied by Fuji Film K.K.--;

Column 20, under the heading "Silver salt printing paper" delete "by Fuji Film K.K.";

Column 22, line 1, Claim 11, "resinmodified" should read --resin-modified--;

Signed and Sealed this

Twenty-first Day of December 1976

[SEAL]

*Attest:*

RUTH C. MASON
*Attesting Officer*

C. MARSHALL DANN
*Commissioner of Patents and Trademarks*